US011079122B2

(12) United States Patent
Casper et al.

(10) Patent No.: US 11,079,122 B2
(45) Date of Patent: Aug. 3, 2021

(54) MODULAR LIQUID BASED HEATING AND COOLING SYSTEM

(71) Applicant: JOHNSON CONTROLS TECHNOLOGY COMPANY, Holland, MI (US)

(72) Inventors: Ian Michael Casper, York, PA (US); Dirck Lyon, Grand Rapids, MI (US); Walter E. Doll, Buford, GA (US); John R. Schwartz, Delafield, WI (US); Martin Yu, Shanghai (CN); Li Li Mow, Lorong (SG); Rick Van Buren, North Richland Hills, TX (US); Roberto De Paco, Jr., Terrassa (ES); John Evan Bade, York, PA (US); Cesar Serrano, Weston, FL (US); Daniela Bilmanis, New Carrollton, MD (US); Satheesh Kulankara, York, PA (US); Justin P. Kauffman, York, PA (US); Brian Smith, York, PA (US); Mark A. Adams, York, PA (US); Martin L. Doll, Jr., York, PA (US); Nicholas Staub, York, PA (US); Richard W. Nadeau, Red Lion, PA (US); William L. Kopko, Jacobus, PA (US); Chris Paraskevakos, York, PA (US); Matthew J. Shaub, Mount Joy, PA (US); Sean Gao, York, PA (US); Christian C. Rudio, York, PA (US); Mahesh Valiya Naduvath, Cockeysville, MD (US); Jonathan D. West, York, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 335 days.

(21) Appl. No.: 14/771,325

(22) PCT Filed: Mar. 4, 2014

(86) PCT No.: PCT/US2014/020099
§ 371 (c)(1),
(2) Date: Aug. 28, 2015

(87) PCT Pub. No.: WO2014/137968
PCT Pub. Date: Sep. 12, 2014

(65) Prior Publication Data

US 2016/0003561 A1 Jan. 7, 2016

Related U.S. Application Data

(60) Provisional application No. 61/772,300, filed on Mar. 4, 2013.

(51) Int. Cl.
*F24F 3/08* (2006.01)
*F24F 3/00* (2006.01)
(Continued)

(52) U.S. Cl.
CPC ..... *F24F 3/08* (2013.01); *F24F 3/001* (2013.01); *F24F 11/84* (2018.01); *F28F 13/06* (2013.01)

(58) Field of Classification Search
CPC ..... F24F 3/06; F24F 3/08; F24F 11/83; F24F 11/84; F24F 5/0003; F16L 59/141;
(Continued)

(56) References Cited

U.S. PATENT DOCUMENTS 2,915,298 A * 12/1959 Hamlin ..... B21C 31/00 165/221
3,127,928 A * 4/1964 Ringquist ..... F24F 3/08 165/221
(Continued)

FOREIGN PATENT DOCUMENTS

CA 1187966 A 5/1985
CN 102112815 A 6/2011
(Continued)

OTHER PUBLICATIONS

Chinese Office Action for CN Application No. 201480024979.4 dated Mar. 27, 2017, 9 Pages.

*Primary Examiner* — Joel M Attey
*Assistant Examiner* — For K Ling
(74) *Attorney, Agent, or Firm* — Fletcher Yoder, P.C.

(57) ABSTRACT

A modular water based heating and cooling system for providing chilled or heated water to terminal devices in a building to heat/cool individual zones in the building. The system includes a flow control device in fluid communication with a riser chilled water supply line, a riser chilled water return line, a riser heated water supply line, and a riser heated water return line. The flow control device includes first control valves and second control valves. Terminal device supply lines extend from the flow control device and are connected to respective first control valves. Terminal device return lines extend from the flow control device and are connected to respective second control valves. The first control valves and the second control valves cooperate to supply required chilled water or heated water through the terminal device supply lines to terminal devices based on the cooling/heating requirements of the terminal devices.

24 Claims, 7 Drawing Sheets

(51) Int. Cl.
*F24F 11/84* (2018.01)
*F28F 13/06* (2006.01)

(58) Field of Classification Search
CPC ..... F16L 59/143; F25B 2500/01; F25B 41/04; F25B 2500/2507; F16K 27/003
USPC ..... 165/219, 221; 138/149; 62/185, 189
See application file for complete search history.

(56) References Cited

U.S. PATENT DOCUMENTS 3,127,929 A * 4/1964 Ringquist ..... F24F 3/08 165/221
3,170,508 A * 2/1965 Avery ..... F24F 3/08 165/221
3,195,622 A * 7/1965 Greene, Jr. ..... F24F 11/83 165/101
3,241,602 A * 3/1966 Andreassen ..... F24F 3/08 165/103
3,256,929 A * 6/1966 Carlson ..... F24F 3/06 165/221
3,303,873 A * 2/1967 Ringqulst ..... F24F 3/08 165/221
3,323,584 A * 6/1967 Serratto ..... F24F 1/01 165/103
3,406,744 A * 10/1968 Scheibler ..... F24F 3/08 165/221
3,425,485 A * 2/1969 Newton ..... F24F 5/0003 165/218
3,593,780 A * 7/1971 Donnelly ..... F24F 11/83 165/218
3,627,031 A 12/1971 Ware
3,685,574 A * 8/1972 Worms ..... F24F 3/06 165/221
3,910,345 A 10/1975 Whalen
3,979,922 A 9/1976 Shavit
4,024,728 A 5/1977 Gustafsson
4,076,073 A 2/1978 Yamamoto et al.
4,114,682 A * 9/1978 Knud ..... F24D 19/1006 165/290
4,205,381 A 5/1980 Games et al.
4,271,678 A 6/1981 Liebert
4,313,310 A 2/1982 Kobayashi et al.
4,446,703 A 5/1984 Gilbertson
5,131,236 A 7/1992 Wruck et al.
5,172,565 A 12/1992 Wruck et al.
5,325,676 A 7/1994 Meckler
6,095,426 A 8/2000 Ahmed et al.
6,293,119 B1 9/2001 Wenzel
6,453,993 B1 * 9/2002 Bujak, Jr. ..... F24F 11/83 165/208
6,523,359 B1 2/2003 Posch
6,604,688 B2 8/2003 Ganesh et al.
6,715,691 B2 * 4/2004 Park ..... F24D 3/04 237/8 A
6,826,920 B2 12/2004 Wacker
7,216,698 B2 * 5/2007 Catzel ..... F24F 3/08 165/205
7,340,912 B1 3/2008 Yoho, Sr. et al.
8,025,097 B2 * 9/2011 Di Stefano ..... G05D 23/1393 165/100
8,539,789 B2 9/2013 Kopko et al.
8,733,120 B2 5/2014 Morimoto et al.
9,671,119 B2 6/2017 Yamashita et al.
9,677,717 B2 6/2017 Jenks
2004/0112584 A1 * 6/2004 Weng ..... F24F 11/008 165/299
2008/0116289 A1 5/2008 Lochtefeld
2008/0121286 A1 * 5/2008 Fabricius ..... F24F 3/06 137/377
2009/0188985 A1 * 7/2009 Scharing ..... F24F 3/06 237/1 R
2010/0287960 A1 * 11/2010 Meister ..... F25B 29/003 62/77
2010/0307733 A1 * 12/2010 Karamanos ..... F24F 11/006 165/254
2012/0031130 A1 * 2/2012 Morimoto ..... F16K 27/003 62/196.1
2012/0180515 A1 * 7/2012 Morimoto ..... F24F 3/06 62/324.6
2012/0211118 A1 * 8/2012 Tognon ..... F16L 11/22 138/149
2012/0304675 A1 12/2012 Motomura et al.
2012/0304681 A1 12/2012 Morimoto et al.
2015/0176876 A1 6/2015 Tamura et al.

FOREIGN PATENT DOCUMENTS

EP 1239205 A2 * 9/2002 ..... F16L 11/22
EP 2481996 A1 8/2012
FR 1482567 A * 5/1967 ..... F24F 3/08
GB 809904 A 3/1959
GB 1105059 A 3/1968
GB 1166047 A 10/1969
GB 1166047 A * 10/1969 ..... F24F 3/08
GB 2295888 A 6/1996
JP 2006029744 A 2/2006
JP 2006145098 A 6/2006
JP 2006258390 A 9/2006
JP 2007183045 A 7/2007
JP 2007321995 A 12/2007
JP 2008051427 A 3/2008
JP 2008082653 A 4/2008
JP 2008224182 A 9/2008
JP 2008309428 A 12/2008
JP 2009030823 A 2/2009
JP 2009036485 A 2/2009
JP 2009299910 A 12/2009
JP 2010096360 A 4/2010
JP 2010112579 A 5/2010
JP 2010156493 A 7/2010
JP 2011052883 A 3/2011
JP 2012214104 A 11/2012
JP 2013198465 A 10/2013

(56) References Cited

FOREIGN PATENT DOCUMENTS

| | | | |
|---|---|---|---|
| KR | 20100046694 | A | 5/2010 |
| TW | 337547 | B | 8/1998 |
| TW | 425470 | B | 3/2001 |
| TW | 200912215 | A | 3/2009 |
| WO | 2010052853 | A1 | 5/2010 |
| WO | 2012104890 | A1 | 8/2012 |
| WO | 2014016865 | A1 | 7/2016 |
| WO | 2014024276 | A1 | 7/2016 |

* cited by examiner

MODULAR LIQUID BASED HEATING AND COOLING SYSTEM

FIELD OF THE INVENTION

The present invention is generally directed to the field of heating, and air conditioning systems which use a hydronic medium, such as chilled water. In particular, the invention is directed to a modular system which enables coordinated selection of components for optimum performance and can provide simultaneous heating and cooling.

BACKGROUND OF THE INVENTION

A range of systems are known and presently in use for heating and cooling of liquids such as water, brine, air, and so forth. In many building systems, the hydronic liquid is heated or cooled and then circulated through the building where it is channeled through air handlers that blow air through heat exchangers to heat or cool the air, depending upon the season and building conditions.

When both the heating and cooling systems are water-based, it is common to have two separate sets of supply and return pipes running through the building (a 4-pipe system) to accommodate the circulation of the heated and chilled water. This type of system provides increased comfort to the zones of the building. Alternatively, in changeover systems, one set of supply and return pipes can be used. In the changeover systems only one function, either heating or cooling, can be performed at one time. Valves are provided to switch between the circulation of the water between chilled water and hot water operation in the spring and fall (2-pipe changeover system). 2-pipe systems are less costly but compromise the comfort level.

While 4-pipe systems can deliver hot water and chilled water at the same time, 4-pipe systems use a lot of pipe and are costly to install. In addition, two sets of trunk lines are required to be run throughout the building. These pipes are typically expensive, heavy, and costly to install and insulate.

During installation of the piping systems, contractors assemble valves and actuators on site, leading to additional expense and possible quality control issues. Additionally, as the valves are located somewhere between the main trunk and the unit being controlled, the valves are often difficult for maintenance people to find, and when they do, discover they are in an inconvenient location to access. As many valves are located in the plenum above the ceiling, the repair and maintenance of the valves requires working from a ladder. Further, the valve is the system component that is most likely to require service and/or maintenance, and when it is located in the plenum above the ceiling, often the first indication of that leak is damage to the ceiling.

It would be beneficial to provide a system which overcomes the problems associated with the prior art and which allows chilled and heated water to be drawn from a primary riser system to deliver the comfort required to respective terminal units within a building at a low cost while still providing the overall comfort benefits of a 4-pipe system.

SUMMARY OF THE INVENTION

One embodiment is directed to a modular liquid based heating and cooling system for providing heating and air conditioning in a building. The system includes a riser chilled liquid supply line, a riser chilled liquid return line, a riser heated liquid supply line, and a riser heated liquid return line. A flow control device is provided in fluid communication with the riser chilled liquid supply line, the riser chilled liquid return line, the riser heated liquid supply line, and the riser heated liquid return line. The flow control device includes at least one first control valve in fluid communication with the riser chilled liquid supply line and the riser heated liquid supply line; at least one second control valve in fluid communication with the riser chilled liquid return line and the riser heated liquid return line; at least one terminal device supply line which extends from the at least one first control valve; and at least one terminal device return line which extends from the at least one second valve control. At least one terminal device is in fluid communication with the at least one terminal device supply line and the at least one terminal device return line. The at least one first control valve and the at least one second control valve cooperate to supply required chilled liquid or heated liquid through the at least one terminal device supply line to the at least one terminal device based on the cooling/heating requirements of the at least one terminal device.

In some embodiments, the riser chilled liquid supply line and the riser chilled liquid return line are connected to a chiller and a first primary pump which provides sufficient pressure to force the liquid through the riser chilled liquid supply line and the riser chilled liquid return line.

In some embodiments, the riser heated liquid supply line and the riser heated liquid return line are connected to a heat pump and a second primary pump which provides sufficient pressure to force the liquid through the riser heated liquid supply line and the riser heated liquid return line.

In some embodiments, the at least one terminal device includes multiple terminal devices which are positioned in individual zones in the building, wherein respective first individual terminal devices of the multiple terminal devices may require heated liquid to be supplied while respective second individual terminal devices of the multiple terminal devices may require chilled liquid to be supplied simultaneously, thereby allowing the respective first terminal devices to operate in a cooling mode while the respective second terminal devices operate simultaneously in a heating mode.

In some embodiments, the chilled liquid is delivered to the at least one terminal device at temperatures between 50 degrees Fahrenheit to 65 degrees Fahrenheit.

In some embodiments, the heated liquid is delivered to the at least one terminal device at temperatures between 95 degrees Fahrenheit to 115 degrees Fahrenheit.

In some embodiments, the flow control device is located proximate the riser chilled liquid supply line, the riser chilled liquid return line, the riser heated liquid supply line, and the riser heated liquid return line.

In some embodiments, the flow control device has a secondary pump which moves the chilled liquid through the flow control device and a secondary pump which moves the heated liquid through the flow control device.

In some embodiments, a controller is provided to control the secondary pumps and the valves to regulate the flow of the chilled liquid and the heated liquid through the flow control device.

One embodiment is directed to a modular water based heating and cooling system for providing chilled or heated water to terminal devices in a building to heat/cool individual zones in the building. The system includes a flow control device in fluid communication with a riser chilled water supply line, a riser chilled water return line, a riser heated water supply line, and a riser heated water return line. The flow control device includes first control valves in fluid communication with the riser chilled water supply line and the riser heated water supply line; and second control valves in fluid communication with the riser chilled water return line and the riser heated water return line. Terminal device supply lines extend from the flow control device and are connected to respective first control valves. Terminal device return lines extend from the flow control device and are connected to respective second control valves. Terminal devices are provided in fluid communication with the terminal device supply lines and the terminal device return lines. The first control valves and the second control valves cooperate to supply the required chilled water or heated water through the terminal device supply lines to the terminal devices based on the cooling/heating requirements of the terminal devices.

In some embodiments, the terminal devices are positioned in the individual zones in the building, wherein respective first individual terminal devices may require heated water to be supplied while respective second individual terminal devices may require chilled water to be supplied simultaneously, thereby allowing the respective first terminal devices to operate in a cooling mode while the respective second terminal devices operate simultaneously in a heating mode.

In some embodiments, the riser chilled water supply line and the riser chilled water return line are connected to a chiller and a first primary pump which provides sufficient pressure to force the water through the riser chilled water supply line and the riser chilled water return line.

In some embodiments, the riser heated water supply line and the riser heated water return line are connected to a heat pump and a second primary pump which provides sufficient pressure to force the water through the riser heated water supply line and the riser heated water return line.

In some embodiments, respective terminal devices are heat exchangers with a single coil which is in fluid communication with the terminal device supply lines and the terminal device return lines.

In some embodiments, the chilled water is delivered to respective terminal devices at temperatures between 40 degrees Fahrenheit to 65 degrees Fahrenheit.

In some embodiments, the heated water is delivered to respective terminal devices at temperatures between 90 degrees Fahrenheit to 180 degrees Fahrenheit.

In some embodiments, respective terminal devices are zero energy devices which do not use fan or other power requirements when using the heated or cooled fluid to condition the individual zones.

In some embodiments, the flow control device is located proximate the riser chilled water supply line, the riser chilled water return line, the riser heated water supply line, and the riser heated water return line.

In some embodiments, the terminal device supply lines and the terminal device return lines are provided in a flexible pre-insulated bundle.

In some embodiments, the flexible pre-insulated bundle includes a control wire which provides an electrical connection between a respective terminal device and the flow control unit.

In some embodiments, the flow control device has a secondary pump which moves the chilled water through the flow control device and the terminal devices, and a secondary pump which moves the heated water through the flow control device and the terminal devices.

In some embodiments, a controller is provided to regulate the flow of the chilled water and the heated water through the flow control device.

In some embodiments, control valves are six-way valves, three-way valves, two-way valves or a combination thereof.

In some embodiments, an air handler unit is connected to the riser chilled water supply line, the riser chilled water return line, the riser heated water supply line, and the riser heated water return to heat/cool spaces in the building which are too large for the terminal devices.

In some embodiments, multiple flow control devices are provided in the building.

One embodiment is directed to a flow control device for use in a water based heating and cooling system for providing chilled or heated water to terminal devices in a building to heat/cool individual zones in the building. The flow control device includes a flow control device chilled water supply line in fluid communication with a riser chilled water supply line; a flow control device chilled water return line in fluid communication with a riser chilled water return; a flow control device heated water supply line in fluid communication with a riser heated water supply line; and a flow control device heated water return line in fluid communication with a riser heated water return. First control valves are in fluid communication with the flow control device chilled water supply line and the flow control device heated water supply line. Second control valves are in fluid communication with the flow control device chilled water return line and the flow control device heated water return line. Terminal device supply lines extend from the first control valves and terminal device return lines extend from the second control valves. The first control valves and the second control valves cooperate to supply required chilled water or heated water through the terminal device supply lines to terminal devices based on the cooling/heating requirements of the terminal devices.

In some embodiments, the flow control device chilled water supply line and the flow control device chilled water are adjacent, and wherein the flow control device heated water supply line and the flow control device heated water return line are adjacent.

In some embodiments, the flow control device chilled water supply line and the flow control device heated water supply line, and wherein the flow control device chilled water are adjacent and the flow control device heated water return line are adjacent.

In some embodiments, a controller is provided to regulate the flow of the chilled water and the heated water through the flow control device.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
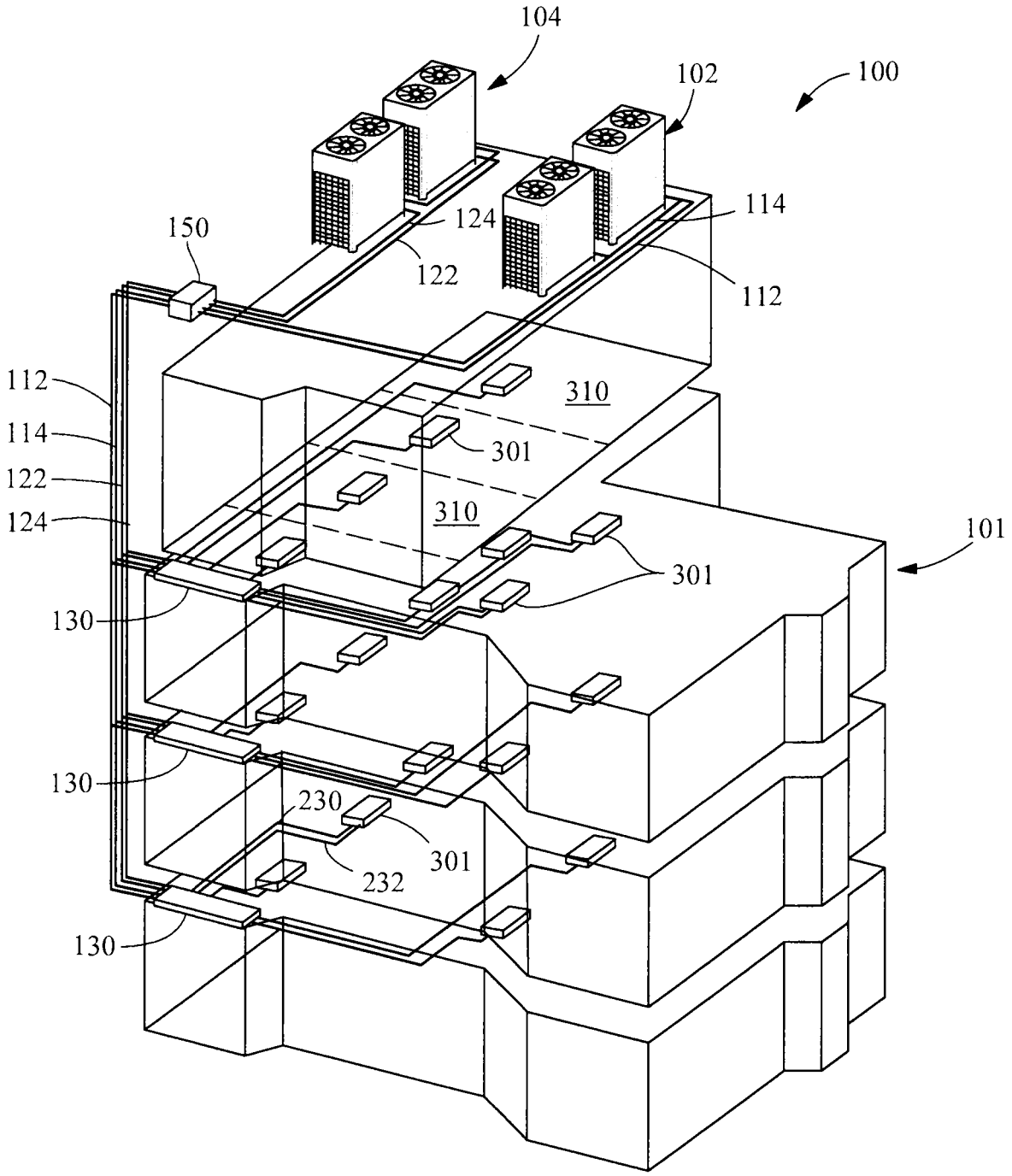
FIG. 1 is a perspective schematic view of an illustrative modular liquid based heating and cooling system according to the disclosure.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

Figure 2:
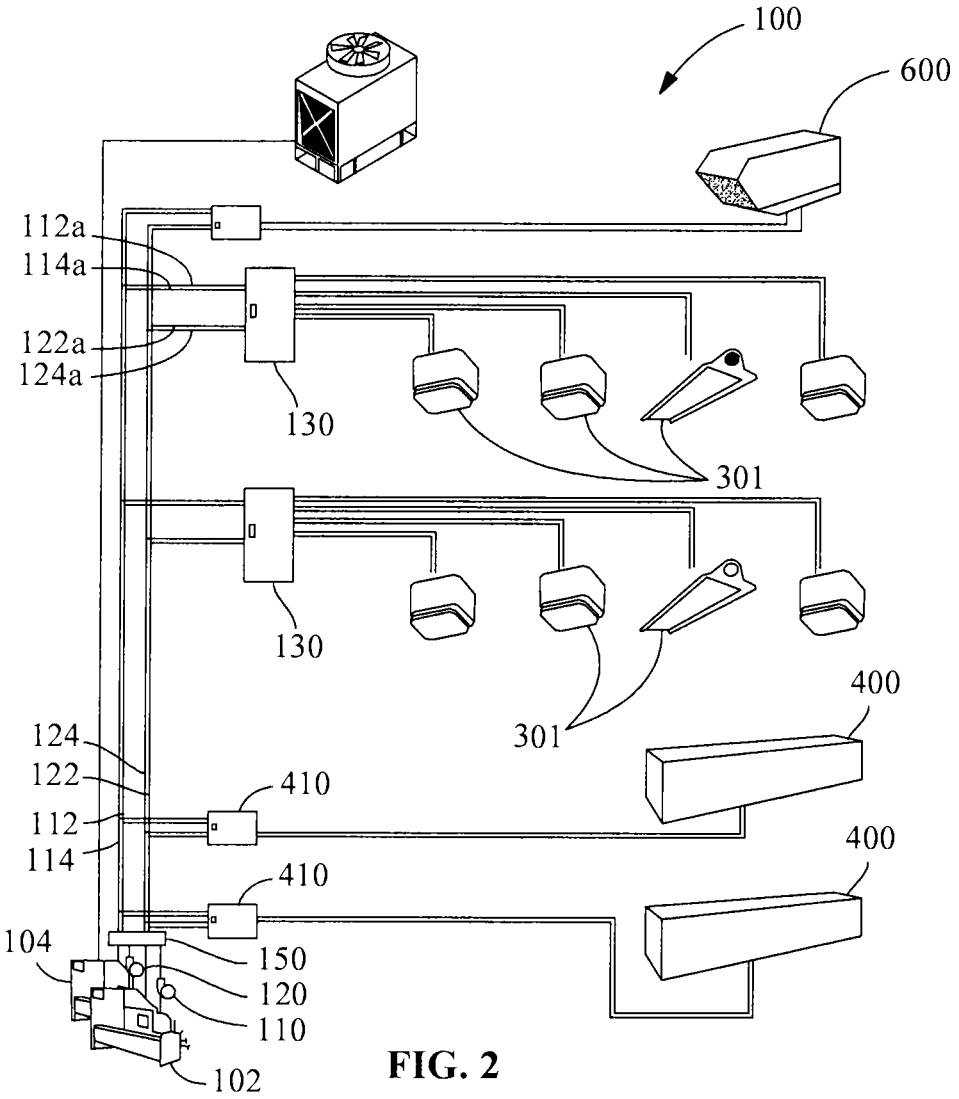
FIG. 2 is an alternate schematic view of the illustrative modular liquid based heating and cooling system according to the disclosure.

FIGS. 1 and 2 show illustrative liquid or water based heating and cooling systems 100 for a building 101 in a typical commercial setting. The systems 100 include a chiller 102 to supply a chilled liquid and a heat pump 104 to supply a heated liquid. In the exemplary embodiment shown, the chiller 102 and heat pump 104 are located on the roof, however the chiller 102 and heat pump 104 may be located in other areas, such as, but not limited to the basement. Although the illustrative embodiment shows a chiller 102 and heat pump 104, other embodiments may replace the chiller with another heat pump.

Liquid from the chiller 102 is pumped by a primary pump 110 through a riser chilled liquid supply line 112 to various flow control devices 130 located on various floors of the building 101, as will be more fully described below. The primary pump 110 provides sufficient pressure to the riser chilled liquid supply line 112 to force the liquid through the riser chilled liquid supply line 112 and the riser chilled liquid return line 114. The liquid is returned to the chiller 102 through a chilled liquid return line or pipe 114. The liquid may be, but is not limited to, water, brine, glycol or other liquids having the heat transfer characteristics required for proper operation of the system 100. The primary pump 110 provides sufficient pressure to force the liquid through the riser chilled liquid supply line 112 and the riser chilled liquid return line 114.

Liquid from the heat pump 104 is pumped by a primary pump 120 through a riser heated liquid supply line 122 to various flow control devices 130 located on various floors of the building 101, as will be more fully described below. The liquid is returned to the heat pump 104 through a heated liquid return line or pipe 124. The liquid may be, but is not limited to, water, brine, glycol or other liquids having the heat transfer characteristics required for proper operation of the system 100. The primary pump 120 provides sufficient pressure to force liquid through the riser heated liquid supply and the riser heated liquid return line 124.

While the system 100 shown refers to specific heating and cooling sources, many different heating or cooling sources can be used as the primary source or the back-up source. Cooling sources include, but are not limited to, chillers, heat pump chillers, simultaneous heating and cooling chillers, district cooling, ground loops, and thermal storage. Heating sources include, but are not limited to, boilers, district heating, ground loops, solar arrays, and thermal storage.

In addition, in mild to moderate climates, the heating and cooling can be consolidated into one unit, such as, but not limited to, a simultaneous heat/cool heat pump, thereby allowing energy to be shared between respective hot and cold spaces in the building 101. An example of such a unit is shown in U.S. Pat. No. 8,539,789, which is incorporated herein in its entirety. In a building 101 with multiple units all on the same system 100, one or more units would be configured for simultaneous operation in order to allow for the energy to be shared between the respective hot and cold spaces in the building 101. When one or more units are used device 150 is used to direct the flow of the heated or cooled liquid to/from the appropriate riser supply line 112, 122 and the appropriate riser return line 114, 124. Valves (not shown) direct heated liquid to riser supply line 122 and from riser return line 124 or chilled liquid to riser supply line 112 and from riser return line 114.

In the exemplary embodiment shown, each riser supply line 112, 122 has manifolds or similar devices which direct the chilled or heated liquid to smaller pipes or lines 112*a*, 122*a* which branch off from the riser supply lines 112, 122 at each floor of the building. The branches 112*a*, 122*a* supply respective liquids to respective flow control devices 130. Additionally, each riser return line 114, 124 has manifolds or similar devices which allow the used chilled or heated liquid to be received from smaller pipes or lines 114*a*, 124*a* which extended into the riser return line 114, 124 at each floor of the building. The supply lines 112*a*, 122*a* and the return lines 114*a*, 124*a* have sufficient diameters to allow for the required liquid flow. For example, the diameters of the supply lines 112*a*, 122*a* and the return lines 114*a*, 124*a* may be between, but are not limited to, ¾ inch to 2 inches.

The supply lines 112*a*, 122*a* supply respective liquids from the riser supply lines 112, 122 to respective regulatory valve boxes or flow control devices 130. The return lines 114*a*, 124*a* return respective liquids from the respective flow control devices 130 to the riser return lines 114, 124. While the system 100 is shown with a single flow control device 130 on each floor of the building 101, other configurations can be used without departing from the scope of the invention. For example, in an alternative embodiment, system 100 may include only one flow control device 130 for every two floors. In another alternative embodiment, system 100 may include more than one flow control device 130 on one or more floors.

Figure 3:
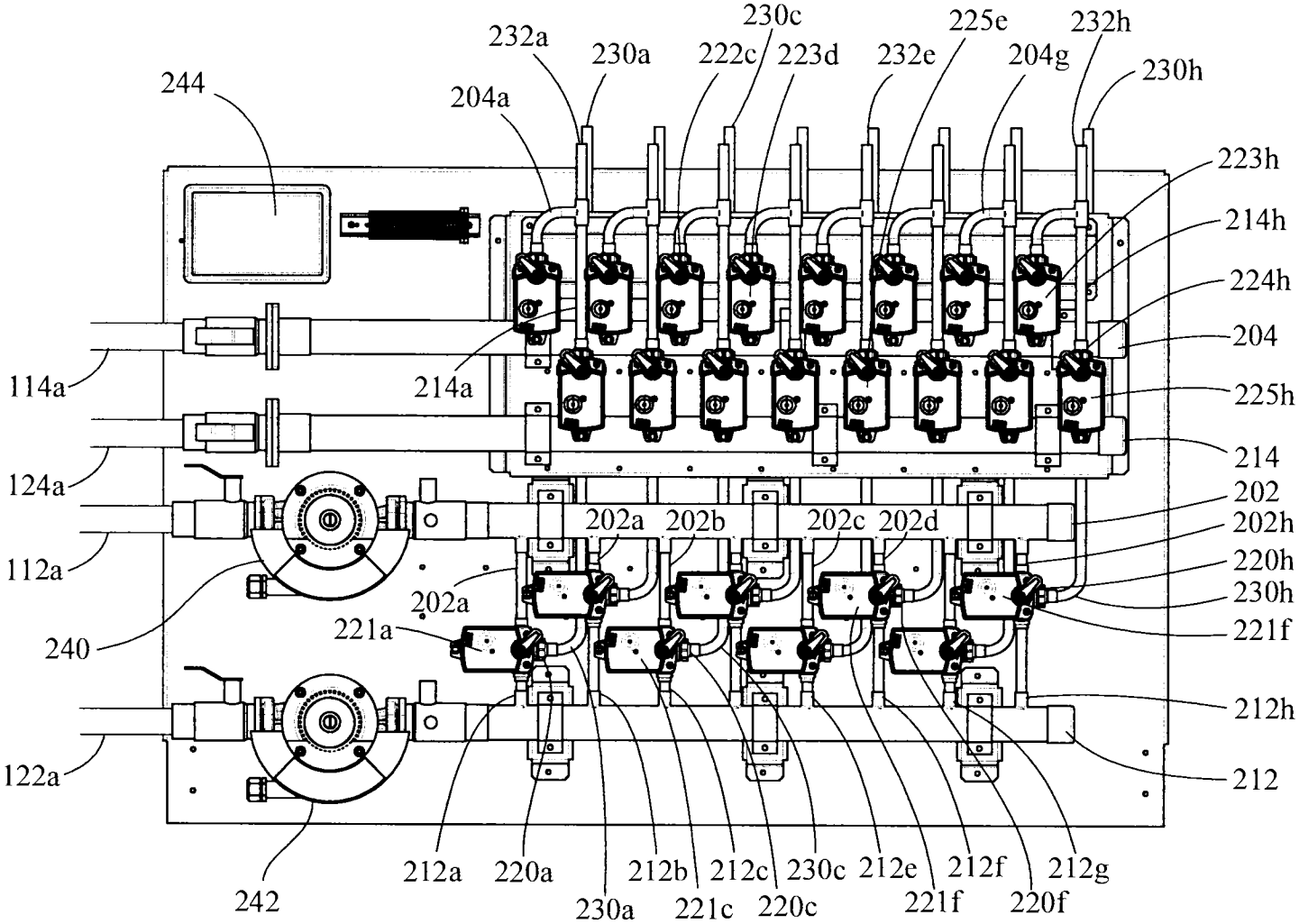
FIG. 3 is a plan view of an illustrative flow control device for use in the modular system.

Referring to FIG. 3, a representative illustrative embodiment of the flow control device 130 is shown. The flow control device 130 has a chilled liquid supply line 202, a chilled liquid return line 204, a heated liquid supply line 212 and a heated liquid return line 214. In the embodiment shown, the chilled liquid supply line 202 is positioned proximate or adjacent the heated liquid supply line 212 and the chilled liquid return line 204 is positioned proximate or adjacent the heated liquid return line 214. The chilled liquid supply line 202 and the heated liquid supply line 212 are mechanically connected to the supply lines 112*a*, 122*a* using known connection devices. The chilled liquid return line 204 and the heated liquid return line 214 are mechanically connected to the return lines 114*a*, 124*a* using known connection devices. In so doing, the flow control device or panel 130 is placed in fluid communication with the riser chilled liquid supply line 112, the riser chilled liquid return line 114, the riser heated liquid supply line 122, and the riser heated liquid return line 124.

Smaller chilled liquid supply lines 202*a-h* extend from the chilled liquid supply line 202. Similarly, heated liquid supply lines 212*a-h* extend from the heated liquid supply line 212. As best shown in FIG. 2, respective chilled liquid supply lines 202 and respective heated liquid supply lines 212 are provided in fluid communication with a liquid control valve 220. In the illustrative embodiment shown, liquid control valves 220 are three-way valves configured to control an amount of chilled liquid and/or heated liquid permitted to pass through the liquid control valves 220 into supply lines 230. The liquid control valves 220 may be configured to modulate the flow rate from the supply lines 230 to either the chilled liquid supply line 202 or the heated liquid supply lines 212. Alternatively, the liquid control valves 220 may be configured to switch the flow between supply lines 230 and either the chilled liquid supply line 202 or the heated liquid supply lines 212 (e.g., without splitting or mixing).

Smaller chilled liquid return lines 204*a-h* are connected to the chilled liquid return line 204. Similarly, heated liquid return lines 214*a-h* are connected to the heated liquid return line 214. As best shown in FIG. 3, respective chilled liquid return lines 204 and respective heated liquid return lines 214 are provided in fluid communication with liquid control valves 222, 224. In the illustrative embodiment shown, liquid control valves 222, 224 are two-way valves configured to control an amount of chilled liquid and/or heated liquid permitted to pass through the liquid control valves 222, 224 from the return lines 232 into respective return lines 204, 214. The control valves 222, 224 are configured to selectively divert liquid from the return lines 232 to either the chilled liquid return line 204 or the heated liquid return line 214. The liquid control valves 222, 224 may include, but not limited to, standard valves known in the industry. The liquid control valves 222, 224 may be configured to modulate the flow rate from either the return lines 232 to either the chilled liquid return line 204 or the heated liquid return lines 214. Alternatively, the liquid control valves 222, 224 may be configured to switch the flow between from return lines 232 to either the chilled liquid return line 204 or the heated liquid return lines 214 (e.g., without splitting or mixing).

Figure 4:
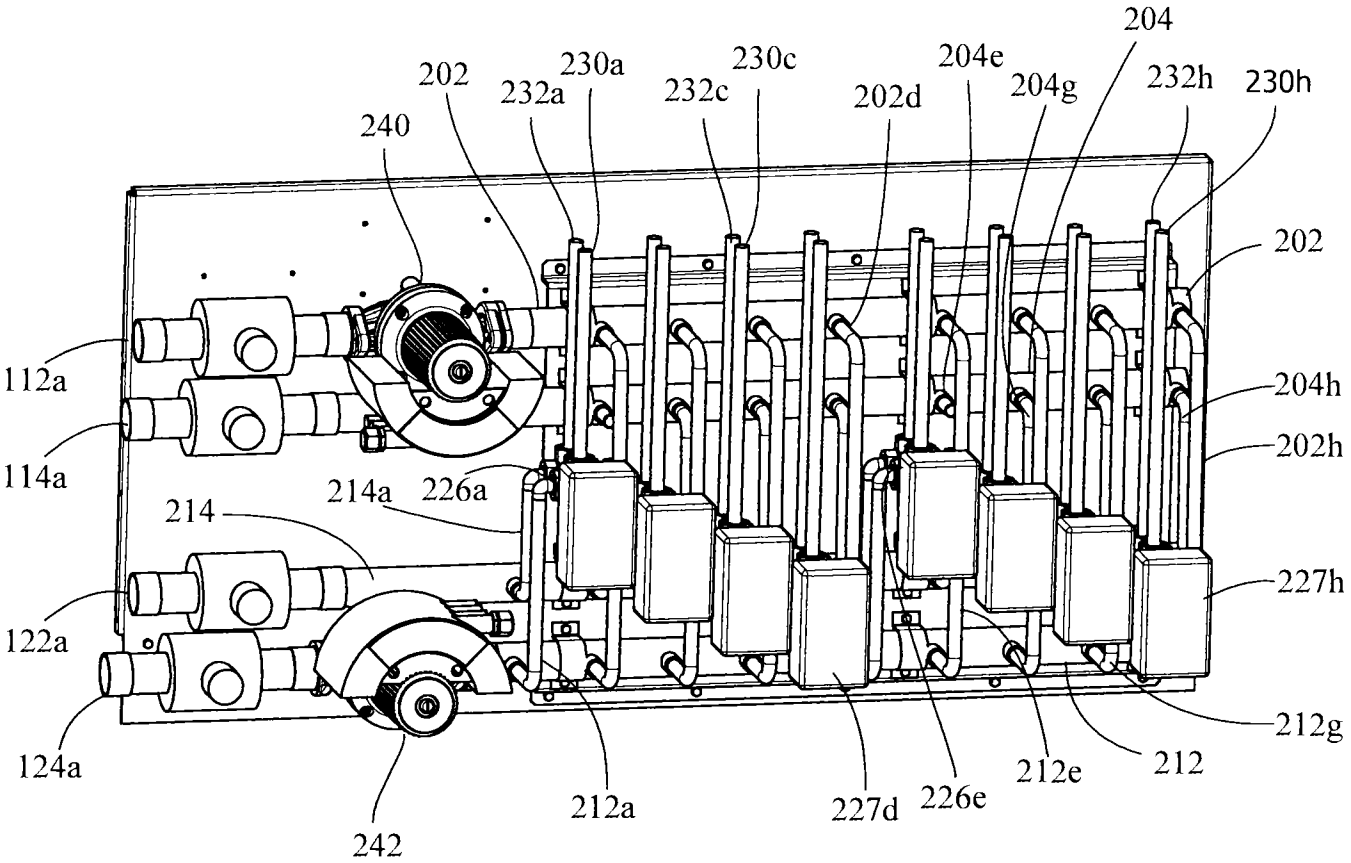
FIG. 4 is a plan view of an alternate illustrative flow control device for use in the modular system.

In addition, as shown in FIG. 4, the two-way and three way valves 220, 222, 224 may be replaced with other valves such as, but not limited to, two-way valves, three way valves, six way valves 226 which are configured to rotate by 270 degrees to modulate the flow rate of the liquids, as described in co-pending U.S. patent application Ser. No. 14/178,052, filed Feb. 11, 2014, which is incorporated herein in its entirety, or any combination thereof. The valves 226 combine the function of valves 220, 222, 224.

In the illustrative embodiments shown, the supply lines 202, 212 and the return lines 204, 214 have sufficient diameters to allow for the required liquid flow. For example, the diameters of the supply lines 202, 212 and the return lines 204, 214 may be between, but are not limited to, ½ inch to 1 inch. While eight of each of the supply lines 202, supply lines 212, return lines 204, return lines 214, valves 220, valves 222, and valves 224 are shown, any numbers may be included in the flow control device 130, including but not limited to, greater than 1, less than 17, between 2 and 16, between 4 and 8, or any combination or sub-combination thereof.

The liquid control valves 220, 222, 224 may be made from any of a variety of materials including, but not limited to, metals (e.g., cast iron, brass, bronze, copper, steel, stainless steel, aluminum, etc.), plastics (e.g., PVC, PP, HDPE, etc.), glass-reinforced polymers (e.g., fiberglass), ceramics, or any combination thereof.

Each flow control device 130 may further includes secondary liquid pumps 240, 242. Pump 240 may be liquidly connected with the chilled liquid supply line 202 and pump 242 may be liquidly connected with the heated liquid supply line 212. Pumps 240, 242 move the chilled liquid and the heated liquid through the flow control device 130 and the respective terminal devices 301 attached to the respective supply lines 230 and return lines 232. Pumps 240, 242 may work to maintain liquid supplies at a particular state or condition (e.g., a particular liquid pressure, flow rate, etc.). Pumps 240, 242 may be operated by controller 244 (e.g., in response to a control signal received from the controller 244), by a separate controller, or in response to a power signal or control signal received from any other source.

In the illustrative embodiment shown, the pumps 240, 242 are powered by a motor (not shown), such as, but not limited to, an ECM motor or an induction motor with separate variable frequency drive. The motor varies in speed or rpm in response to changing conditions in the system. In so doing, the motor causes the pumps 240, 242 to maintain the required flow and head of the liquid in the respective supply lines 202, 212 for the proper operation of the indoor terminal units 301. Consequently, the head and power required in the primary pumps 110, 120 is reduced, thereby allowing implementation of primary variable flow at the chiller 102 and the heat pump 104. The combination of locating the secondary pumps 240, 242 closer to the individual heating/cooling zones 310 and using a variable flow results in the reduction of required pumping power compared with known systems by as much as 30%.

The use of the motor in conjunction with pumps 240, 242 facilitates automatic balancing of the flow of liquid. In the prior art, balancing the flow in a hydronic system is difficult because the liquid pressure at the valves is continually changing, thereby requiring expensive pressure independent valves or manual balancing valves with complex, manual commissioning steps unique to every application. In contrast, with the flow control device 130 of the present invention, the pumps 240, 242 controlled by the motor provide distributed pumping, as described above, thereby ensuring, in some illustrative embodiments, that the liquid control valves 220 will always experience the same pressure.

The controller 244 may be configured to operate actuators 221 *a-h* to regulate liquid flow through the valves 220 and to select either the chilled water supply or the heated water supply to the supply lines 230. The controller 244 may be configured to operate actuators 223 *a-h*, 225 *a-h* to regulate liquid flow through the valves 222, 224. The controller 244 may be configured to direct the liquid from the return lines 232 to either the chilled liquid return line 204 or the heated liquid return line 214 and to control a flow rate of the return liquid by adjusting a rotational position of valve 222, 224. In the embodiment shown in FIG. 4, the controller 244 may be configured to operate actuators 227 *a-h* regulate liquid flow through the valves 226 and to select either the chilled water supply or the heated water supply to the supply lines 230.

In some embodiments, the controller 244 is a feedback controller configured to receive feedback signals from various sensors (e.g., temperature sensors, pressure sensors, flow rate sensors, position sensors, etc.). The sensors may be arranged to measure a flow rate, temperature, pressure, or other state or condition at various locations within the liquid system.

Figure 5:
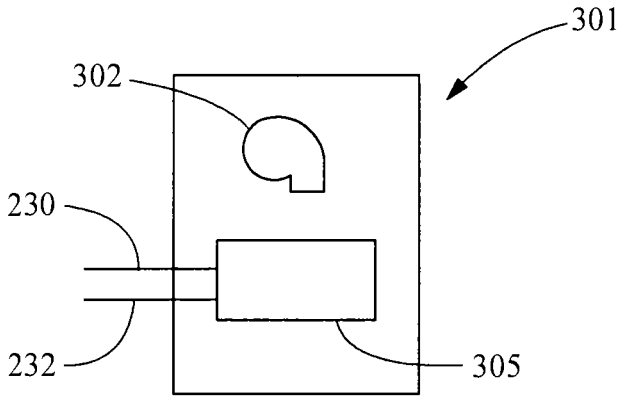
FIG. 5 is a schematic view of an illustrative terminal device for use in the modular system.
Figure 6:
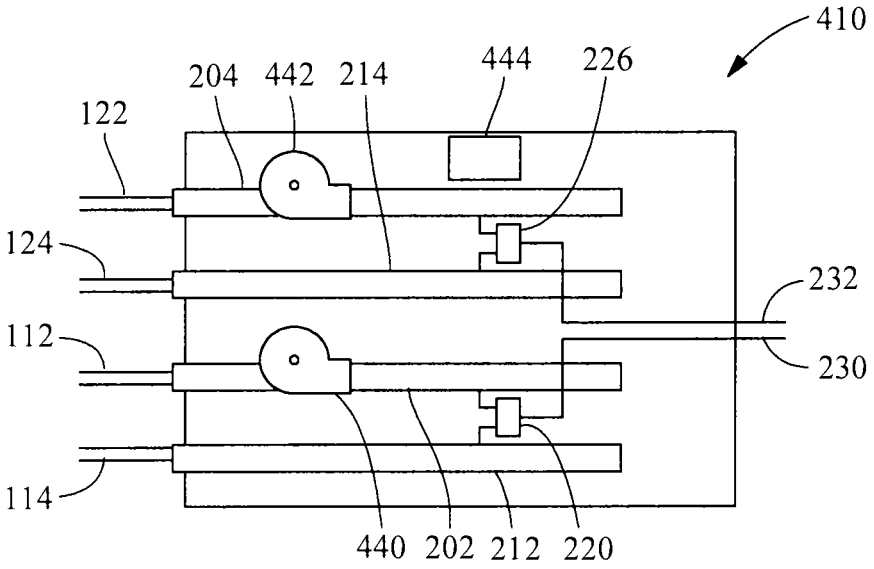
FIG. 6 is a plan view of an illustrative feeder box for use in the modular system.

In the illustrative embodiment shown in FIG. 5, each supply line 230 is in liquid engagement with a terminal unit or device 301 with a single heat exchanger 305 positioned in an individual heating/cooling zone 310, such as, but not limited to a room or interior space of the building 101. The heat exchanger 305 is used for both heating and cooling an interior space of the building 101. A fan 302 moves air over the heat exchanger 305 to properly disperse the heating/cooling into the individual heating/cooling zone 310. The heat exchanger 305 of the terminal device 301 uses the liquid from a respective supply line 230 as a thermal source from which heat energy can be absorbed (e.g., from hot water or another warm liquid) and/or into which heat energy can be rejected (e.g., into cold water or another coolant). A respective return line 232 is also in liquid engagement with the heat exchanger 305. In the embodiment shown, the liquid used by the heat exchanger 305 of each terminal device 301 is returned via a respective return line 232. Stated differently, the terminal devices 301 intake liquid from the supply lines 230 and output liquid to the return lines 232.

In the embodiment shown, each terminal device 301 uses a single heat exchanger 305 for both cooling and heating. The heat exchangers 305 are sized to provide a sufficient heat transfer surface area to allow the heat exchangers 305 to operate efficiently for both heating and cooling. The heat exchangers 305 are also sized to provide a sufficient heat exchange surface area to allow for an effective heat exchange between the heat exchangers 305 of the terminal units 301 and the individual heating/cooling zone 310. This allows the same individual heating/cooling zone 310 to be heated using liquid with a lower temperature than known systems and cooled using liquid with a higher temperature than known systems, thereby increasing the efficiency of the system.

In the illustrative embodiment shown, when in a cooling mode, the temperature of the chilled liquid delivered to the heat exchangers 305 through the supply line 230 is greater than about 40 degrees Fahrenheit, greater than about 50 degrees Fahrenheit, less than about 65 degrees Fahrenheit, between about 40 degrees Fahrenheit and about 65 degrees Fahrenheit, between about 50 degrees Fahrenheit and about 65 degrees Fahrenheit, between about 55 degrees Fahrenheit and about 60 degrees Fahrenheit, about 55 degrees Fahrenheit, about 60 degrees Fahrenheit or any combination or sub-combination thereof. The temperature of the liquid exiting the heat exchangers 305 through the return line 232 is greater than about 65 degrees Fahrenheit, less than about 80 degrees Fahrenheit, between about 65 degrees Fahrenheit and about 80 degrees Fahrenheit, between about 65 degrees Fahrenheit and about 70 degrees Fahrenheit, about 65 degrees Fahrenheit, about 70 degrees Fahrenheit or any combination or sub-combination thereof. In contrast, with known liquid systems, when in cooling mode, the temperature of the liquid entering the cooling coil is about 44 degrees Fahrenheit and the liquid exiting the cooling coil is about 54 degrees Fahrenheit. Optimizing a complete system of components (i.e. chillers, heat pumps, terminal devices, etc) to use warmer liquid to cool the individual heating/cooling zones 310 improves the overall efficiency of the system 100 as the liquid does not need to be cooled to the temperatures required in known systems. In addition, as the water leaving the chiller 102 (or heat pumps) can be warmer than in known systems, the capacity of the chiller (or heat pumps) increases, allowing smaller, less expensive chillers (or heat pumps) to be used.

In the illustrative embodiment shown, when in a heating mode, the temperature of the heated liquid delivered to the heat exchangers 305 through the supply line 230 is greater than about 90 degrees Fahrenheit, greater than about 95 degrees Fahrenheit, less than about 115 degrees Fahrenheit, less than about 180 degrees Fahrenheit, between about 90 degrees Fahrenheit and about 180 degrees Fahrenheit, between about 95 degrees Fahrenheit and about 115 degrees Fahrenheit, between about 100 degrees Fahrenheit and about 110 degrees Fahrenheit, about 100 degrees Fahrenheit, about 105 degrees Fahrenheit or any combination or sub-combination thereof. The temperature of the liquid exiting the heat exchangers 305 through the return line 232 is greater than about 85 degrees Fahrenheit, less than about 105 degrees Fahrenheit, between about 85 degrees Fahrenheit and about 105 degrees Fahrenheit, between about 90 degrees Fahrenheit and about 100 degrees Fahrenheit, about 90 degrees Fahrenheit, about 100 degrees Fahrenheit or any combination or sub-combination thereof. In contrast, with various known liquid systems, when in heating mode, the temperature of the liquid entering the separate heating coil is about 160 degrees Fahrenheit and the liquid exiting the separate heating coil is about 140 degrees Fahrenheit. The ability to use cooler liquid to heat the individual heating/cooling zones 310 improves the overall efficiency of the system 100 as the liquid does not need to be heated to the temperatures required in known systems. In addition, as the water leaving the heat pump 104 can be colder than in known systems, the capacity of the heat pump increases, allowing smaller, less expensive heat pumps to be used.

While the terminal unit 301 shown has a fan 302 and heat exchanger 305, other types of terminal units can be used, such as, but not limited to, fan coils, radiators, chilled beams, radiant panels, cassettes, or heated/cooled floors/ceilings or other zero energy devices which use no fan or other power requirements when using the heated or cooled fluid to condition the individual zones 310.

The supply lines 230 and return lines 232 may be made from any of a variety of materials including, but not limited to, metals (e.g., cast iron, brass, bronze, copper, steel, stainless steel, aluminum, etc.), plastics (e.g., PVC, PP, HDPE, etc.), glass-reinforced polymers (e.g., fiberglass), ceramics, or any combination thereof. In order to maintain the required temperatures in the supply lines 230 and return lines 232 and to prevent condensation forming, the supply lines 230 and return lines 232 are wrapped with insulation. Insulation may be made from a variety of materials including, but not limited to, mineral wool, glass wool, flexible elastomeric foam, rigid foam, polyethylene, and cellular glass.

Figure 7:
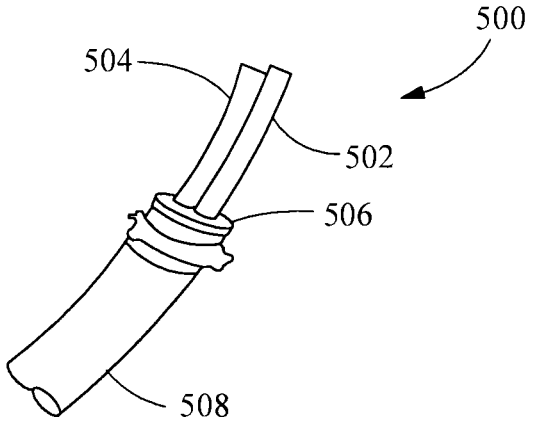
FIG. 7 is a perspective view of an illustrative flexible pre-insulated bundled line set for use in the modular system.
Figure 8:
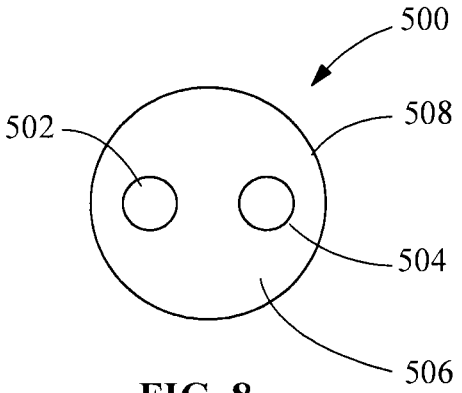
FIG. 8 is a cross-sectional view of the flexible pre-insulated bundled line set of FIG. 7.

Alternatively, as shown in FIGS. 7 and 8, a flexible pre-insulated bundled piping or line set 500 can be used. In the illustrative embodiment shown, the line set 500 includes two carrier pipes 502, 504. As best shown in FIG. 8, the pipes 502, 504 are spaced apart. Insulation 506 is provided between the carrier pipes 502, 504 to prevent thermal transfer between the carrier pipes 502, 504. The insulation 506 also extends about the entire circumference of each carrier pipe 502, 504 to encompass each carrier pipe 502, 504, thereby maintaining the required temperatures of the liquid in the carrier pipes 502, 504 and preventing condensation from forming on the carrier pipes 502, 504. In the illustrative embodiment carrier pipe 502 is the supply line 230 and carrier pipe 504 is the return line 232. The line set 500 may encased in a tough but flexible jacket 508.

The carrier pipes 502, 504 may be made from any of a variety of materials including, but not limited to, plastic cross linked polyethylene. The insulation 506 may be made from any of a variety of materials including, but not limited to, polyurethane foam. The jacket 508 may be made from any of a variety of materials including, but not limited to, extruded polyethylene.

In the embodiment shown, the carrier pipes 502, 504, the insulation 506 and the jacket 508 are mechanically linked to one another and move collectively during expansion/contraction. The line set 500 installs quickly and easily without brazing welding or special tools resulting in a lower installed cost when compared to other types of piping. As the line set 500 is flexible, the need for joints, elbows and fittings is minimized, thereby providing a seamless pipe system.

Figure 9:
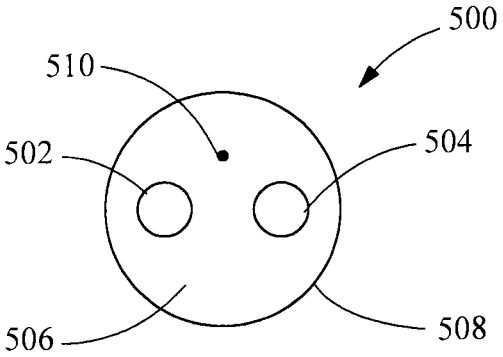
FIG. 9 is a cross-sectional view of an alternate flexible pre-insulated bundled line set for use in the modular system.

A control wire 510 may be imbedded in the line set 500, as shown in FIG. 9. The control wire 510 is secured in the insulation 506 and is spaced from the carrier pipes 502, 504. When installed, the control wire 510 is provided in electrical engagement with a respective terminal unit 301 and a respective controller 244. This provides an electrical connection between the terminal units 301 and their respective controller 244 of the flow control device 130, thereby allowing the controller 244 to receive electrical input from the terminal device 301 and sensors associated therewith. The controller 244 uses the input to adjust the flow of the liquids accordingly, as was previously described.

The line set 500 is manufactured in long continuous lengths. At installation, the installer cuts the line set 500 to the lengths desired for each run between the flow control device 130 and the terminal device 301. The liquid and electrical connections between the line set 500 and the terminal unit 301 and between the line set 500 and the flow control device 130 are done using known methods.

The use of the flow control devices 130 converts a 4-pipe system located in the riser (i.e. riser chilled liquid supply line 112, riser heated liquid supply line 122, riser chilled liquid return line 114, and riser heated liquid return line 124) into a 2-pipe system (i.e. supply line 230 and return line 232). This allows the system to be both low cost to install and modular in nature and allows various terminal devices 301 to operate in a cooling mode while other terminal devices 301 operate simultaneously in a heating mode. As an example, based on information received from sensors in individual heating/cooling zones 310 *a, d, f, g*, the controller 244 can position liquid control valves 220 *a, d, f, g* to allow chilled liquid to enter the supply lines 230 *a, d, f, g* from the chilled liquid supply line 202. The controller can also position liquid control valves 222 *a, d, f, g* and 224 *a, d, f, g* to allow the used chilled liquid to return through the return lines 232 *a, d, f, g* to the chilled liquid return line 204. This allows the chilled liquid to run through the terminal devices 301 *a, d, f, g* to cool the individual heating/cooling zones 310 *a, d, f, g*. At the same time, based on information received from sensors in individual heating/cooling zones 310 *b, c, e, h*, the controller 244 can position liquid control valves 220 *b, c, e, h* to allow heated liquid to enter the supply lines 230 *b, c, e, h* from the heated liquid supply line 212. The controller can also position liquid control valves 222 *b, c, e, h* and 224 *b, c, e, h* to allow the used heated liquid to return through the return lines 232 *b, c, e, h* to the heated liquid return line 214. This allows the heated liquid to run through the terminal devices 301 *b, c, e, h* to cool the individual heating/cooling zones 310 *b, c, e, h*.

The flow control devices 130 can be located near the heating/cooling loads and proximate the 4-pipe risers, e.g. the riser chilled liquid supply line 112, the riser chilled liquid return line 114, the riser heated liquid supply line 122, and the riser heated liquid return line 124, to facilitate the individual heat/cooling zones to switch between a hot and cold liquid loop. In addition, the flow control devices 130 allow for a factory piping and wiring of control valves and secondary pumping, eliminating field labor and enabling easier central maintenance and service.

As only two pipes or lines are used from the flow control devices 130 to the individual terminal devices 301, the use of the flow control devices 130 reduces the amount of piping required to enable a system that allows for individual zones to operate with some in cooling and some in heating mode. The use of the flow control devices 130 and the two pipes also allows for a single terminal device 301, with a single heat exchanger 305, to switch between heating and cooling piping water loops. This allows for the elimination of a second heat exchanger in the terminal device. The use of the two pipes may also reduce the total number of valves and actuators required to enable a system to operate with some individual zones in cooling and some in heating mode.

The flow control device 130 can be used with changeover systems with only one riser system (i.e. a supply pipe and a return pipe) that can only run in heating or cooling. The flow control devices 130 in a changeover system allows for factory piping and wiring of control valves and secondary pumping, eliminating field labor and enabling easier central maintenance and service. However, as the use of the flow control device 130 does not require users from running four pipes to each terminal device in each zone from a 4-pipe riser system, the cost and space required for the system described herein is comparable to the price of a changeover system, thereby reducing the advantages of changeover systems.

In large open spaces of the building 101 in which large distributed loads are too large for smaller terminal units 301, an air handling unit 400 (as known in the art) may be used. As is known in the art, the air handling unit 400 may include a plenum housing, a fan, sometimes referred to as a blower, and a heat exchanger. In order to operate properly, the heat exchanger is in liquid communication with the chilled liquid supply line 112, the chilled liquid return line 114, the heated liquid supply line 122, and heated liquid return line 124. However, as no secondary pumps are provided in the riser, the air handling unit 400 must be connected to the riser supply lines and return lines by a feeder pump box 410.

The feeder pump box 410 includes liquid pumps 440 and 442. Pump 440 may be liquidly connected with the chilled liquid supply line 112 and pump 442 may be liquidly connected with the heated liquid supply line 122. Pumps 440 and 442 may work to maintain liquid supplies at a particular state or condition (e.g., a particular liquid pressure, flow rate, etc.). Pumps 440, 442 may be operated by controller 444 (e.g., in response to a control signal received from controller 444), by a separate controller, or in response to a power signal or control signal received from any other source. In addition, the feeder box 410 may be similar to the flow control device 130 described above, but with fewer valves 220, 226. This would allow two pipes to run from the riser lines to the air handling unit 400 rather than the four pipes required with known units. The feeder box 410 with the air handling unit 400 allows for factory piping and wiring of control valves and secondary pumping, eliminating field labor and enabling easier central maintenance and service.

Figure 10:
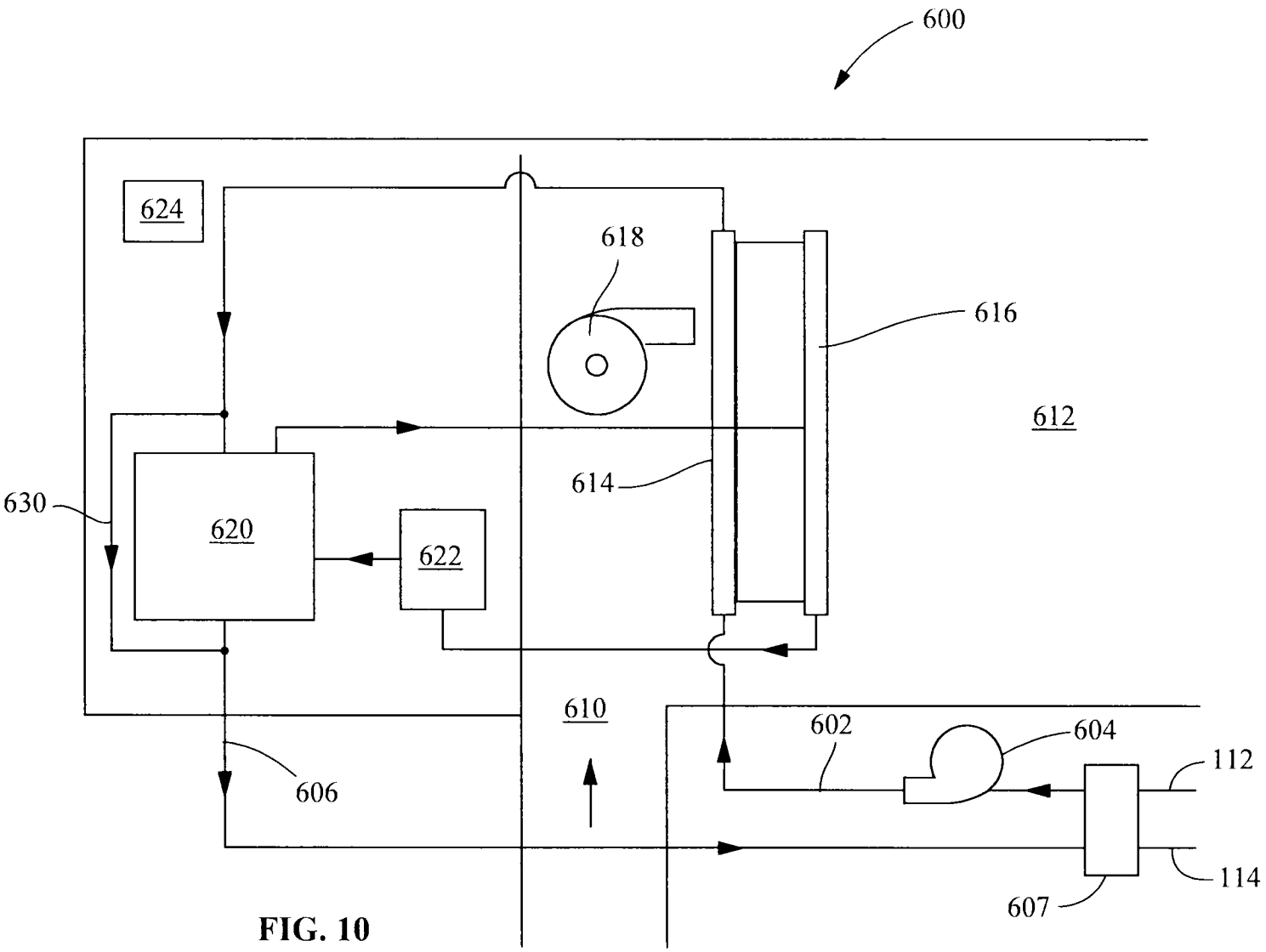
FIG. 10 is a schematic view of an illustrative outside air unit for use in the modular system.

Referring to FIG. 10, an outside air conditioning or handling unit 600 is shown. In many larger buildings outside air is needed to meet the ventilation needs, it is not sufficient to have all indoor cooling/heating units. While some building can meet the needs with operable windows, many buildings require that ventilation air volumes must be delivered to the individual zone whether cooling/heating is needed or not. Therefore, is often preferred to have a system deliver conditioned air through an air handling unit 600.

As shown in FIG. 10, an outside air handling unit 600 receives chilled liquid through a supply line 602. The chilled liquid supply line 602 is connected to the riser chilled liquid supply line 112 or other supply line or member of the chilled liquid loop or cooling loop of the building 101. A pump 604 may be provided to facilitate or regulate the movement of the liquid through the unit 600. The pump 604 may be, but is not limited to, a variable speed pump or other known hydronic pumps. A return line 606 returns the discarded liquid from the unit 600 to the riser chilled liquid return line 114 or other return line or member of the chilled liquid loop of the building 101 in the event that the unit is utilized. A flow control 607 may be provided between the supply line 602 and the supply line 112 and between the return line 606 and the return line 114. The flow control 607 may have valves (not shown) which control the flow of liquid between the supply line 602 and the supply line 112 and between the return line 606 and the return line 114.

The air handling unit 600 has an air inlet 610 and an air outlet 612. The air handling unit 600 includes a first coil 614 serving as a pre-cooling or first heat absorbing device to pre-cool the outside air as the outside air enters the air handling unit 600 through the air inlet 610. Also provided within the air handling unit 600 is a second or evaporator coil 616 which, in some modes of operation, serves as a second heat absorbing device to further condition the outside air after the outside air encounters the first coil 614. A fan 618 is provided within the air handling unit 600 to circulate air successively through the first coil 614 and the evaporator coil 616. A liquid cooled condenser 620 and compressor 622 are also provided in the air handling unit 600. A control unit 624 is provided to control the operation of the unit 600, including the flow control 607. The control unit 624 is any known control which can be used to operate the unit 600. The control unit 624 may have circuitry or the like which receives signals from various sensors or other similar devices located inside and outside of the building 101, thereby providing sufficient input to allow the control unit 624 to determine when and how the air handling unit 600 should be engaged.

Although a first or liquid coil 614 and single evaporator coil 616 are shown, multiple coils 614 and evaporator coils 616 may be provided in each individual air handling unit 600 if desired. It should also be understood that, in such systems, individual control valves may be provided for controlling the flow of cooling liquid to the individual ones of multiple coils and/or evaporator coils in each unit.

In use, chilled liquid is supplied to the first coil 614 during operating periods when cooling is called for in the building 101. The degree or amount of cooling provided by the unit 600 is contingent upon the amount of cooling required in the building 101. If desired, the flow rate of chilled water through the coils 614 may be controlled to control the cooling capacity of the unit 600.

Under low heat load circumstances, the chilled liquid is supplied to the first coil 614. The fan 618 forces outside air received through the air inlet 610 across the coil 614 to condition the air. The conditioned air is then forced to the air outlet 612 which is connected to air ducts in the building 101. The air ducts transfer the conditioned outside air to respective zones in the building 101. In this mode of operation, the coil 614 provides sufficient conditioning of the air to meet the need of the building and, therefore, the evaporator 616 is not needed to condition the air. Consequently, the fluid exits the coil 614 and bypasses the compressor 622 by way of the bypass circuit 630. The liquid exiting the coil 614 passes through the condenser 620 to the riser chilled liquid return line 114 through the return line 606. In so doing, the compressor 622 is not engaged, thereby increasing efficiency and helping to extend the life of the compressor.

When the heat load in the building unit associated with air handling unit 600 becomes too great for the cooling capacity of the coil 614 by itself, the compressor 622 is engaged. In this mode of operation, the fluid exiting the coil 614 flows through the condenser 620, allowing the fluid to cool the refrigerant of the condenser 620. As the condenser 620 and the compressor 622 and evaporator 616 are of the type known in the industry, a further explanation of their operation will not be provided. The fan 618 forces outside air received through the air inlet 610 across the coil 614 and the active evaporator coil 616 to condition the air. The conditioned air is then forced to the air outlet 612 which is connected to air ducts in the building 101. The air ducts transfer the conditioned outside air to respective zones in the building 101. The liquid exiting the coil 614 passes back through the condenser 620 to the riser chilled liquid return line 114 through the return line 606. Under these conditions the chilled water supplied through the riser chilled liquid supply line 112 serves a dual purpose of the initial, partial cooling of the air flowing through air handling unit 600 and as the liquid passing through the condenser 620. This allows the required compressor capacity to be reduced, for example, but not limited to, by about 50 percent. In addition, as the load on the compressor 622 is more consistent, the a variable-capacity compressor unit may not need to be provided.

In some application, the outside air entering the unit 600 may be tempered by using air exhaust air from the building to realize energy savings and increasing capacity. This is usually done with devices such as, but not limited to, energy recovery wheels or plat heat exchangers.

It is important to note that the construction and arrangement of the system and components as shown in the various exemplary embodiments are illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Numerous specific details are described to provide a thorough understanding of the disclosure. However, in certain instances, well-known or conventional details are not described in order to avoid obscuring the description. References to "some embodiments," "one embodiment," "an exemplary embodiment," "an illustrative embodiment" and/or "various embodiments" in the present disclosure can be, but not necessarily are, references to the same embodiment and such references mean at least one of the embodiments.

Alternative language and synonyms may be used for any one or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "illustrative" is used to mean serving as an illustration or example, instance or illustration. Any implementation or design described herein as "illustrative" is not necessarily to be construed as preferred or advantageous over other implementations or designs. Rather, use of the word illustrative is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of liquids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The invention claimed is:

1. A modular liquid based heating and cooling system for providing heating and air conditioning in a building, comprising:

a riser chilled liquid supply line configured to receive a flow of fresh chilled liquid, a riser chilled liquid return line configured to receive a flow of used chilled liquid, a riser heated liquid supply line configured to receive a flow of fresh heated liquid, and a riser heated liquid return line configured to receive a flow of used heated liquid;

a flow control device in fluid communication with the riser chilled liquid supply line, the riser chilled liquid return line, the riser heated liquid supply line, and the riser heated liquid return line, wherein the flow control device comprises a modular housing, and wherein the modular housing comprises:

a plurality of first control valves in fluid communication with the riser chilled liquid supply line and the riser heated liquid supply line, wherein the plurality of first control valves is configured to receive the flow of fresh chilled liquid from the riser chilled liquid supply line and configured to receive the flow of fresh heated liquid from the riser heated liquid supply line;

a plurality of second control valves in fluid communication with the riser chilled liquid return line and the riser heated liquid return line, wherein the plurality of second control valves is configured to receive the flow of used chilled liquid and direct the flow of used chilled liquid toward the riser chilled liquid return line, and wherein the plurality of second control valves is configured to receive the flow of used heated liquid and direct the flow of used heated liquid toward the riser heated liquid return line;

a plurality of terminal device supply lines, wherein each terminal device supply line of the plurality of terminal device supply lines extends from a corresponding first control valve of the plurality of first control valves; and a plurality of terminal device return lines, wherein each terminal device return line of the plurality of terminal device return lines extends from a corresponding second control valve of the plurality of second control valves;

a plurality of terminal devices, wherein each terminal device of the plurality of terminal devices is in fluid communication with a corresponding terminal device supply line of the plurality of terminal device supply lines and a corresponding terminal device return line of the plurality of terminal device return lines; and a controller communicatively coupled to the plurality of first control valves and the plurality of second control valves and configured to send instructions to the plurality of first control valves and the plurality of second control valves to adjust a respective position of each first control valve of the plurality of first control valves and a respective position of each second control valve of the plurality of second control valves, wherein the plurality of first control valves and the plurality of second control valves cooperate to direct the flow of fresh chilled liquid or the flow of fresh heated liquid through the plurality of terminal device supply lines and the plurality of terminal device return lines, such that each terminal device of the plurality of terminal devices receives the flow of fresh chilled liquid or the flow of fresh heated liquid based on cooling or heating requirements of each terminal device.

2. The modular liquid based heating and cooling system as recited in claim 1, wherein the flow of fresh chilled liquid, the flow of used chilled liquid, the flow of fresh heated liquid, and the flow of used heated liquid comprise water.

3. The modular liquid based heating and cooling system as recited in claim 1, wherein the riser chilled liquid supply line and the riser chilled liquid return line are connected to a chiller and are in fluid communication with a first primary pump, and wherein the first primary pump provides sufficient pressure to force the flow of fresh chilled liquid through the riser chilled liquid supply line and to force the flow of used chilled liquid through the riser chilled liquid return line.

4. The modular liquid based heating and cooling system as recited in claim 3, wherein the riser heated liquid supply line and the riser heated liquid return line are connected to a heat pump and are in fluid communication with a second primary pump, and wherein the second primary pump provides sufficient pressure to force the flow of fresh heated liquid through the riser heated liquid supply line and to force the flow of used heated liquid through the riser heated liquid return line.

5. The modular liquid based heating and cooling system as recited in claim 1, wherein the plurality of terminal devices is disposed within individual zones of the building, wherein a first terminal device of the plurality of terminal devices receives the flow of fresh chilled liquid and a second terminal device of the plurality of terminal devices receives the flow of fresh heated liquid, such that the first terminal device operates in a cooling mode while the second terminal device operates in a heating mode.

6. The modular liquid based heating and cooling system as recited in claim 1, wherein at least one terminal device of the plurality of terminal devices is a heat exchanger with a single coil, wherein the single coil is in fluid communication with a first terminal device supply line of the plurality of terminal device supply lines and a first terminal device return line of the plurality of terminal device return lines.

7. The modular liquid based heating and cooling system as recited in claim 6, wherein the flow of fresh chilled liquid is delivered to the at least one terminal device at a first temperature between 40 degrees Fahrenheit and 65 degrees Fahrenheit.

8. The modular liquid based heating and cooling system as recited in claim 7, wherein the flow of fresh heated liquid is delivered to the at least one terminal device at a second temperature between 90 degrees Fahrenheit and 180 degrees Fahrenheit.

9. The modular liquid based heating and cooling system as recited in claim 1, wherein at least one terminal device of the plurality of terminal devices is a zero energy device.

10. The modular liquid based heating and cooling system as recited in claim 1, wherein the flow control device is located proximate the riser chilled liquid supply line, the riser chilled liquid return line, the riser heated liquid supply line, and the riser heated liquid return line.

11. The modular liquid based heating and cooling system as recited in claim 1, wherein at least one terminal device supply line of the plurality of terminal device supply lines and at least one terminal device return line of the plurality of terminal device return lines are provided in a flexible pre-insulated bundle.

12. The modular liquid based heating and cooling system as recited in claim 11, wherein the at least one terminal device supply line and the at least one terminal device return line are in fluid communication with a respective terminal device of the plurality of terminal devices, and wherein the flexible pre-insulated bundle includes a control wire which provides an electrical connection between the respective terminal device and the controller.

13. The modular liquid based heating and cooling system as recited in claim 1, wherein the controller is configured to adjust the plurality of first control valves and the plurality of second control valves to regulate the flow of fresh chilled liquid, the flow of used chilled liquid, the flow of fresh heated liquid, and the flow of used heated liquid through the flow control device.

14. The modular liquid based heating and cooling system as recited in claim 1, wherein at least one first control valve of the plurality of first control valves is a three-way valve or a two-way valve.

15. The modular liquid based heating and cooling system as recited in claim 1, wherein at least one second control valve of the plurality of second control valves is a three-way valve.

16. The modular liquid based heating and cooling system as recited in claim 1, wherein at least one second control valve of the plurality of second control valves is a two-way valve.

17. The modular liquid based heating and cooling system as recited in claim 1, wherein the modular housing further comprises:

- a flow control device chilled liquid supply line in fluid communication with the riser chilled liquid supply line and the plurality of first control valves;
- a flow control device chilled liquid return line in fluid communication with the riser chilled liquid return line and the plurality of second control valves;
- a flow control device heated liquid supply line in fluid communication with the riser heated liquid supply line and the plurality of first control valves, wherein the flow control device heated liquid supply line is configured to receive the flow of fresh heated liquid, and wherein the flow of fresh heated liquid comprises heated liquid received from a heat pump without having flown through any terminal device of the plurality of terminal devices; and
- a flow control device heated liquid return line in fluid communication with the riser heated liquid return line and the plurality of second control valves, wherein the flow control device heated liquid return line is configured to receive the flow of used heated liquid, and wherein the flow of used heated liquid comprises heated liquid having flown through at least one terminal device of the plurality of terminal devices.

18. The modular liquid based heating and cooling system as recited in claim 1, wherein the flow of fresh heated liquid comprises heated liquid received from a heat pump without having flown through any terminal device of the plurality of terminal devices.

19. The modular liquid based heating and cooling system as recited in claim 18, wherein the flow of used heated liquid comprises heated liquid having flown through at least one terminal device of the plurality of terminal devices.

20. The modular liquid based heating and cooling system as recited in claim 1, wherein the riser chilled liquid supply line and the riser chilled liquid return line are in fluid communication with a first primary pump, and the riser heated liquid supply line and the riser heated liquid return line are in fluid communication with a second primary pump.

21. The modular liquid based heating and cooling system as recited in claim 20, wherein the modular housing includes:

a first secondary pump in fluid communication with the riser chilled liquid supply line, wherein the first secondary pump is configured to direct the flow of fresh chilled liquid through each terminal device supply line of the plurality of terminal device supply lines; and a second secondary pump in fluid communication with the riser heated liquid supply line, wherein the second secondary pump is configured to direct the flow of fresh heated liquid through each terminal device supply line of the plurality of terminal device supply lines.

22. The modular liquid based heating and cooling system as recited in claim 1, wherein the modular housing includes:

a first pump in fluid communication with the riser chilled liquid supply line, wherein the first pump is configured to direct the flow of fresh chilled liquid through each terminal device supply line of the plurality of terminal device supply lines; and a second pump in fluid communication with the riser heated liquid supply line, wherein the second pump is configured to direct the flow of fresh heated liquid through each terminal device supply line of the plurality of terminal device supply lines; and wherein the controller is communicatively coupled to the first pump and the second pump and configured to control operation of the first pump and the second pump.

23. The modular liquid based heating and cooling system as recited in claim 1, wherein the controller is positioned within the modular housing.

24. The modular liquid based heating and cooling system as recited in claim 1, wherein the plurality of first control valves includes a plurality of first actuators configured to adjust the respective position of each first control valve of the plurality of first control valves, wherein the plurality of second control valves includes a plurality of second actuators configured to adjust the respective position of each second control valve of the plurality of second control valves, and wherein the controller is communicatively coupled to and configured to send instructions to the plurality of first actuators and the plurality of second actuators to adjust the respective position of each first control valve of the plurality of first control valves and the respective position of each second control valve of the plurality of second control valves.

* * * * *